US008572811B2

(12) United States Patent
Lautenschlåger

(10) Patent No.: US 8,572,811 B2
(45) Date of Patent: Nov. 5, 2013

(54) FURNITURE HINGE

(76) Inventor: Horst Lautenschlåger, Reinheim (DE)

( * ) Notice: Subject to any disclaimer, the term of this patent is extended or adjusted under 35 U.S.C. 154(b) by 0 days.

(21) Appl. No.: 13/173,196

(22) Filed: Jun. 30, 2011

(65) Prior Publication Data

US 2012/0260461 A1 Oct. 18, 2012

(30) Foreign Application Priority Data

Apr. 15, 2011 (DE) ..... 10 2011 002 117

(51) Int. Cl.

| | |
|---|---|
| ***E05F 1/08*** | (2006.01) |
| ***E05F 3/20*** | (2006.01) |
| ***E05F 1/10*** | (2006.01) |
| ***A47B 88/00*** | (2006.01) |

(52) U.S. Cl.

USPC ..... 16/370; 16/286; 16/50; 16/54; 16/296; 49/386; 312/327

(58) Field of Classification Search

USPC ..... 16/50, 54, 56, 82, 83, 84, 85, 86 C, 286, 16/296, 306, 366, 370; 312/327, 328; 49/386, 398

See application file for complete search history.

(56) References Cited

U.S. PATENT DOCUMENTS

| | | | | | |
|---|---|---|---|---|---|
| 491,898 | A * | 2/1893 | Lowe | 16/54 |
| 1,051,826 | A * | 1/1913 | Shock | 16/50 |
| 1,103,792 | A * | 7/1914 | Märksch | 16/54 |
| 1,134,510 | A * | 4/1915 | Busch | 16/54 |
| 2,259,970 | A * | 10/1941 | Benzick | 16/286 |
| 3,575,483 | A * | 4/1971 | Church et al. | 312/328 |
| 3,971,099 | A * | 7/1976 | Wallace | 16/50 |
| 4,073,037 | A * | 2/1978 | Curry et al. | 16/304 |
| 4,073,038 | A * | 2/1978 | Curry et al. | 16/301 |
| 4,729,616 | A * | 3/1988 | Vogt | 312/325 |
| 4,756,051 | A * | 7/1988 | Shy | 16/50 |
| 4,756,054 | A * | 7/1988 | Mitts et al. | 16/237 |
| 4,843,680 | A * | 7/1989 | Cress et al. | 16/289 |
| 5,211,457 | A * | 5/1993 | Lupynec | 312/184 |
| 5,215,365 | A * | 6/1993 | Godin | 312/328 |
| 5,316,370 | A * | 5/1994 | Newman | 297/313 |
| 6,045,204 | A * | 4/2000 | Frazier et al. | 312/247 |
| 6,618,902 | B2 * | 9/2003 | Wu | 16/298 |
| 6,618,904 | B1 * | 9/2003 | Nagy | 16/370 |
| 6,789,293 | B2 * | 9/2004 | Habegger et al. | 16/343 |
| 7,021,713 | B2 * | 4/2006 | Kao et al. | 297/339 |
| 7,172,010 | B2 * | 2/2007 | Welsh | 160/201 |
| 7,275,284 | B2 * | 10/2007 | Lautenschlager et al. | 16/287 |
| 7,367,086 | B2 * | 5/2008 | Ito | 16/85 |
| 7,571,877 | B2 * | 8/2009 | French et al. | 244/129.5 |
| 7,635,171 | B2 * | 12/2009 | Rapier, III | 312/321.5 |

(Continued)

FOREIGN PATENT DOCUMENTS

| | | | | |
|---|---|---|---|---|
| EP | 1217159 | A2 * | 6/2002 | E05D 3/06 |

*Primary Examiner* — Victor Batson
*Assistant Examiner* — Jason W San
(74) *Attorney, Agent, or Firm* — WRB-IP LLP

(57) ABSTRACT

A furniture hinge for a hinged lid is arranged in a horizontally swiveling manner on a body of a piece of furniture includes a fastening plate and a swivel plate that is arranged in a swiveling manner on the fastening plate by two lever arms that are arranged as parallel linkages. The hinge includes a damping device that can be fixed on the fastening plate. The damping, device includes a damping cylinder and a piston rod that can be displaced in a dampened manner inside the damping cylinder, whereby the piston rod is mechanically linked with a lever arm.

7 Claims, 2 Drawing Sheets

(56) References Cited

U.S. PATENT DOCUMENTS

| | | | | |
|---|---|---|---|---|
| 7,797,796 | B2 * | 9/2010 | Migli | 16/366 |
| 7,810,213 | B2 * | 10/2010 | Brustle | 16/286 |
| 7,886,407 | B2 * | 2/2011 | Resnik et al. | 16/286 |
| 8,082,629 | B2 * | 12/2011 | Migli | 16/366 |
| 8,225,459 | B2 * | 7/2012 | Waltemate et al. | 16/366 |
| 2001/0039762 | A1 * | 11/2001 | Giovannetti | 49/246 |
| 2003/0200625 | A1 * | 10/2003 | Zimmer | 16/306 |
| 2006/0181108 | A1 * | 8/2006 | Cleland et al. | 296/146.4 |
| 2007/0028418 | A1 * | 2/2007 | Kilpinen | 16/286 |
| 2007/0029833 | A1 * | 2/2007 | Kuhr | 296/76 |
| 2007/0046843 | A1 * | 3/2007 | Maxson | 348/841 |
| 2007/0124893 | A1 * | 6/2007 | Brustle | 16/296 |
| 2007/0266912 | A1 * | 11/2007 | Swain | 108/145 |
| 2008/0189906 | A1 * | 8/2008 | Resnik et al. | 16/54 |
| 2008/0276424 | A1 * | 11/2008 | Gunderson | 16/286 |
| 2009/0171470 | A1 * | 7/2009 | Bisinger et al. | 623/43 |
| 2009/0284112 | A1 * | 11/2009 | Mehmen | 312/295 |
| 2010/0109497 | A1 * | 5/2010 | Blersch et al. | 312/405 |
| 2010/0201238 | A1 * | 8/2010 | Caputo | 312/325 |
| 2011/0031857 | A1 * | 2/2011 | Karg | 312/319.1 |
| 2011/0316401 | A1 * | 12/2011 | Cummins et al. | 312/319.2 |
| 2012/0080987 | A1 * | 4/2012 | Takamori | 312/327 |
| 2012/0085607 | A1 * | 4/2012 | Weber | 188/282.1 |
| 2012/0139401 | A1 * | 6/2012 | Huang et al. | 312/319.2 |

* cited by examiner

FURNITURE HINGE

BACKGROUND AND SUMMARY

The invention relates to a furniture hinge for a hinged lid arranged in a horizontally swiveling manner on a body of a piece of furniture comprising a fastening plate and a swivel plate that is arranged in a swiveling manner on the fastening plate by means of two substantially straight lever arms that are arranged as parallel linkages.

Such furniture hinges are known and are used for forward opening hinged lids, for example. Such a forward opening hinged lid that often is not very high, up to the height of a drawer unit, for example, may be arranged directly below a countertop and above a trash container arranged inside a base cabinet so that it is possible to wipe kitchen trash and crumbs from the countertop directly into a trash container that is fastened to the opened hinged lid when an upper side of the hinged lid is opened towards the front.

While the dimensions of a furniture hinge for an upward opening hinged lid on a wall cabinet always must be large enough to allow for a large opening angle and must reliably maintain a front panel fastened to the furniture hinge in an open position, the mechanical requirements and therefore the furniture hinges for the hinged lids arranged in a swiveling manner directly below the countertop are comparatively small.

In order to keep the manufacturing costs as low as possible as well, the furniture hinges known from practical experience for these comparatively small hinged lids comprise a swivel plate to which the swiveling hinged lid can be fastened with the swivel plate being arranged in a swiveling manner on the fastening plate by means of two substantially straight or, respectively, linear lever arms. The two lever arms are forming a parallel linkage arrangement. With such an embodiment the furniture hinge may have a very low profile so that the trash container that is fastened to the hinged lid can reach as far as possible to the left and to the right edge of the hinged lid and no impractical gaps between the trash container and the side walls of the body of the piece of furniture are necessary on the edges of the hinged lid in which the furniture hinges are arranged.

Often the swivel plate is pushed into a closed position or, respectively, held in this closed position by means of a spring device. If the swiveling hinged lid reaches directly below the countertop, the hinged lid, either due to laziness or due to the difficult accessibility, is dropped early directly below the customarily projecting countertop. The hinged lid that is released early snaps into the closed position, which on one hand produces a clearly audible closing sound and on the other hand affects or damages the fastening and the swiveling mechanism of the furniture hinge in the long run.

It is desirable to provide a furniture hinge as the type described in the introduction that allows for a cost-effective easier handling of such a hinged lid and improves the closing motion of the furniture hinge. In addition, it is desirable that the furniture hinge is to have as low a profile as possible and to require only little space.

According to an aspect of the invention a furniture hinge comprises a damping device that can be fixed on the fastening plate. By means of the damping device it is possible to prevent the hinged lid from snapping to a closed position without reduced speed during a closing motion and hitting the body of the piece of furniture with a loud bang. By fixing the damping device on the fastening plate of the furniture hinge, the required mounting is considerably less compared to a damping device that must be fastened separately to the body of the piece of furniture or to the swiveling hinged lid. In a suitable embodiment of the fixing of the damping device on the fastening plate, the mechanical linkage between the damping device and the swiveling hinged lid can be specified so that a manual adjustment of the damping device is not required.

Preferably the damping device comprises a damping cylinder and a piston rod that can be displaced inside the damping cylinder in a dampening manner and in that the piston rod has a mechanical linkage with a lever arm. A piston rod that can be displaced inside a damping cylinder in a dampening manner provides a damping device that can be manufactured cost-effectively and functions reliably over a long period of time. In particular with a short damping device path and low damping forces as they usually occur with hinged lids that are arranged directly below the countertop and have a height that may correspond to a drawer unit, the damping cylinder with the piston rod that is displaceable inside the damping cylinder can be especially small or, respectively, can be arranged in an especially space-saving manner. The damping device has a dampening effect that is velocity-dependent and does not exert any or, respectively, exerts only insignificant force on the completely opened or closed hinged lid.

If the piston rod is arranged in a swiveling manner on a lever arm and counteracts a swiveling motion of the lever arm in a dampening manner, an opening motion as well as a closing motion of the swiveling hinged lid can be dampened.

It was found that a dampening effect for an opening motion of the hinged lid often is not considered necessary, in particular since there usually is a spring device that counteracts the opening motion. In order to keep the manufacturing and mounting costs as low as possible it therefore might be possible for the piston rod to rest on the lever arm and to counteract a spring force during a closing motion of the swiveling motion of the lever arm. If the swiveling hinged lid is opened and the lever arm is swiveled into an open position, the piston rod is displaced out of the damping cylinder by means of a spring device arranged inside or on the damping cylinder until it rests against the lever arm. During a closing motion the lever arm is displaced to a closed position whereby it must displace the piston rod that rests against the lever arm into the damping cylinder against a dampening effect. Since the piston rod merely rests against the lever arm and must not be connected permanently or in a swiveling manner to the lever arm, the manufacturing and mounting for the damping device is reduced considerably.

Preferably the damping device comprises a fastening element on or in which the damping cylinder can be fixed. The fastening element can comprise a bore with an internal thread in at least some sections into which a damping cylinder can be screwed with the damping cylinder having a corresponding external thread. The fastening element can comprise means for fixing or fastening the damping device to the fastening plate.

According to an advantageous embodiment the fastening element comprises a plane seating surface and an angled stop angle. The plane seating surface is used for fixing the fastening element to the fastening plate by means of planar tactile contact. The angled stop angle can encompass the edge of the fastening plate and ensures that the fastening element is neither shifted nor tilted relative to the fastening plate when the plane seating surface rests on a surface of the fastening plate in a planar manner and the stop angle forms a stop on the edge. Separate means for aligning the damping device relative to the swiveling hinged lid or to the lever arm with which the damping device is connected, are not necessary.

For cost reasons it may be possible for the fastening element to comprise a bore for a fastening screw. Since the plane seating surface and the angled stop angle provide a reliable fixing and alignment of the fastening element and thus of the damping device relative to the lever arm, the fastening element must be fixed in the respective position with on single fastening screw only in order to prevent the plane seating surface or the stop angle from disengaging from the fastening plate. The bore expediently is arranged in the area of the plane seating surface congruently with a recess or bore in the fastening plate. The fastening screw can be screwed through the bore in the fastening element as well as through the recess or bore in the fastening plate into the body of the piece of furniture and can be fixed there.

According to an especially advantageous embodiment of the inventive concept a guide cap with a guide groove is arranged on an end of the piston rod facing the lever arm with the dimensions of the guide cap being adapted to a thickness of the lever arm. The guide cap forms a sufficiently wide stop surface for the lever arm independent of a diameter of the piston rod.

The lever arm extends into the guide groove so that this engagement ensures a reliable lateral guide of the piston rod relative to the lever arm.

In order to provide the best possible even dampening effect, the guide groove runs in a plane that is defined by the swiveling motion of the lever arm and has a curvilinear course. The curvilinear course or, respectively, a curved part of the guide groove can be adapted to the shape of the lever arm as well as to an alignment with the piston rod relative to the lever arm. Due to the curvilinear course of the guide groove it is possible for one of the sides of the lever arm to roll off along the guide groove during an opening motion and in particular during a closing motion. This makes it possible to minimize signs of wear and tear as they appear due to the shifting of the lever arm in the guide groove, for example.

In order to ensure that the dampening effect is as reliable as possible, the lever arm comprises a recess into which the piston rod or, respectively, the guide cap of the piston rod engages. The recess can be a vaulting along a side of the lever arm, for example, whose curvilinear course is adapted to the course of the guide groove in the guide cap. This prevents an unintentional lateral shifting of the piston rod or, respectively, the guide cap of the piston rod along the side of the lever arm during an opening or closing motion.

BRIEF DESCRIPTION OF THE DRAWINGS

An exemplary embodiment of the inventive concept, an example of which is shown in the drawing, is explained in more detail in the following paragraphs. The following is shown.

DETAILED DESCRIPTION

Figure 1:
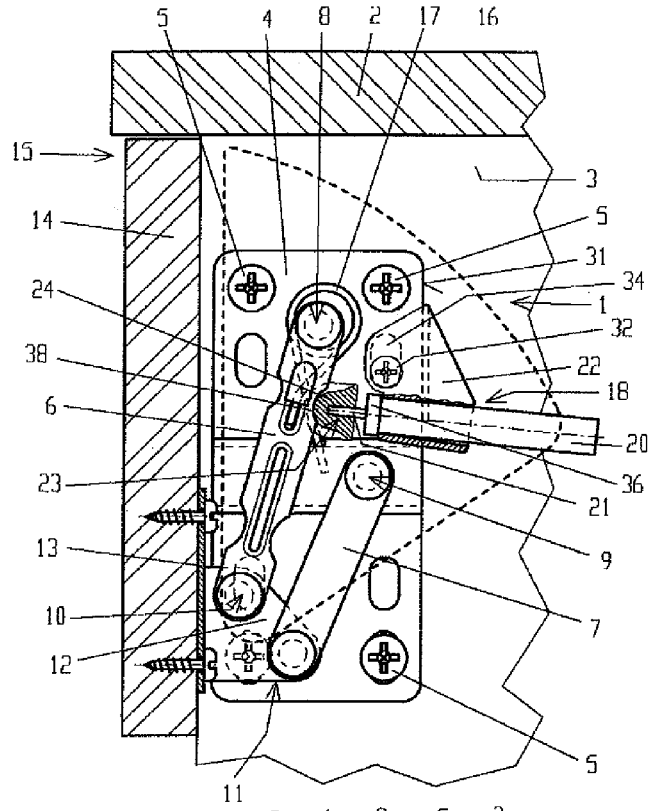
FIG. 1 shows a furniture hinge that is fixed below a countertop to a side wall of a body of a piece of furniture and to which a swiveling hinged lid is fastened horizontally with the swiveling hinged lid being in a closed position.

A furniture hinge 1 is shown in each FIG. 1 and FIG. 2 that is fixed below a countertop 2 on a side wall 3 of a body of a piece of furniture. The furniture hinge 1 comprises a fastening plate 4 that rests on the side wall 3 in a planar manner and is screwed to the side wall 3 by means of four fastening screws 5 that are screwed into the four corners of the rectangular fastening plate 4.

Two lever arms 6 and 7 each are arranged in a swiveling manner on the fastening plate 4 to a first end 8, 9. The two lever arms 6, 7 each are arranged in a swiveling manner on a swivel plate 12 to a second end 10, 11. The two lever arms 6, 7 form a parallel linkage so that the swivel plate 12 can be swiveled relative to the fastening plate 4 between a closed position (shown in FIG. 1) and an open position (shown in FIG. 2). A hinged lid 14 on the front side of the body of the piece of furniture is screwed to a right-angled area 13 of the swivel plate 12. The furniture hinge 1 allows for a horizontal swiveling of the hinged lid 14 whereby a top 15 of the hinged lid 14 can be tilted outward. A tub-shaped trash container 16, indicated by a dashed line only, is fastened to the hinged lid 14. When the hinged lid 14 is in an open position, it is possible to wipe trash and crumbs from the countertop 2 directly over a front edge of the countertop and into the trash container 16.

A bending spring 17 that is wound around the first end 8 of the lever arm 6 counteracts an opening motion of the hinged lid 14 and pushes an almost or completely closed hinged lid 14 into the closed position, as is shown in FIG. 1.

A damping device 18 prevents the hinged lid 14 from being pushed into the closed position by the bending spring 17 without any resistance during a closing motion and banging against a face side 19 of the side wall 3.

The damping device 18 comprises a damping cylinder 20 and a piston rod 21 that is displaceable in a dampening manner inside the damping cylinder 20 with the piston rod 21 extending from the damping cylinder 20. The damping cylinder 20 is fixed in a fastening element 22 and is aligned so that the piston rod 21 rests on the lever arm 6 and counteracts in a dampening manner the accompanying swiveling motion of the lever arm 6 during a closing motion of the hinged lid 14.

Figure 3:
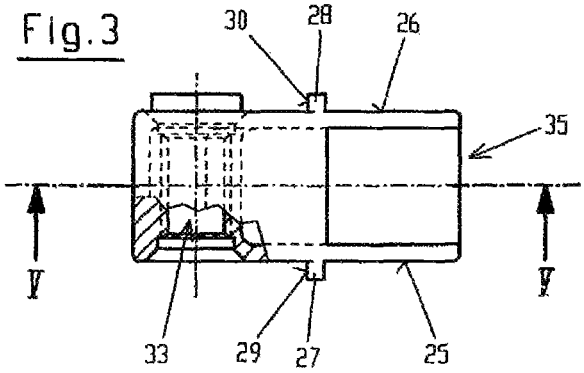
FIG. 3 shows a top view of a fastening element with which a damping cylinder can be fixed on a fastening plate of the furniture hinge.
Figure 4:
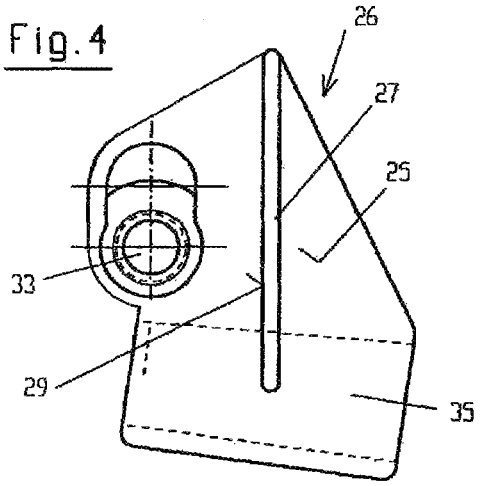
FIG. 4 shows a side view of the fastening element shown in FIG. 3.
Figure 5:
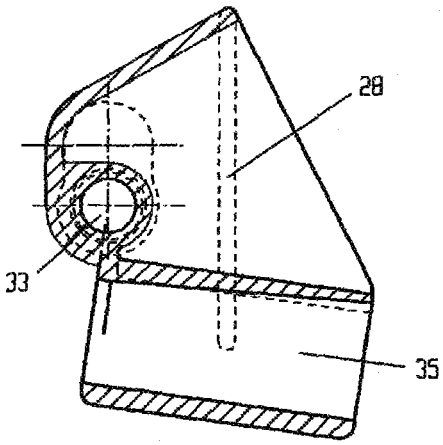
FIG. 5 shows a sectional view of the fastening element shown in FIGS. 3 and 4 along a line V-V in FIG. 3.
Figure 6:
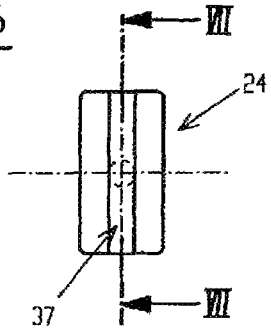
FIG. 6 shows a front view of a guide cap that can be placed over a piston rod extending from the damping cylinder and FIG. 7 shows a sectional view through the guide cap shown in FIG. 6 along line VII-VII in FIG. 6.
Figure 7:
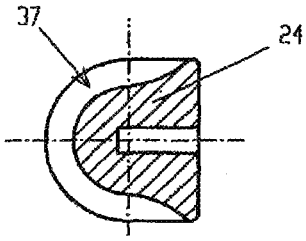

The fastening element 22 is shown from the top in FIG. 3 and from the side in FIGS. 4 and 5 or, respectively, magnified as a sectional view by itself. On the end 23 facing the lever arm 6, the piston rod 21 comprises a guide cap 24, a magnified view of which is shown by itself in FIGS. 6 and 7 as well.

On a side facing the viewer in FIG. 4 the fastening element 22 comprises a plane seating surface 25 and on a side facing away from the viewer also a plane seating surface 26. A thickly raised, straight form 27 or 28, respectively, is formed on both plane seating surfaces 25 and 26. The thickly raised forms 27, 28 each form a stop angle 29, 30. The fastening element 22 is symmetrical relative to a mean plane that corresponds to the sectional plane shown in FIG. 5, so that the fastening element 22 can be fastened to the fastening plate 4 to the left of as well as to the right of a furniture hinge 1.

Figure 2:
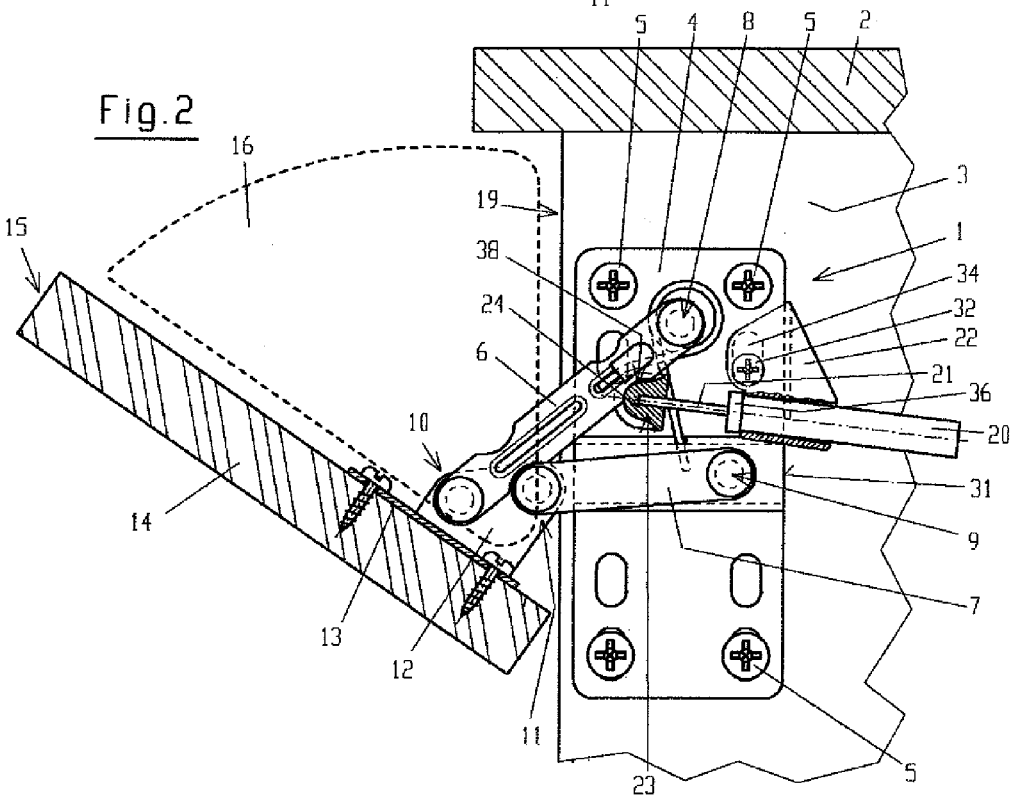
FIG. 2 shows the arrangement shown in FIG. 1 in which the swiveling hinged lid is in an open position.

In the embodiment shown in FIGS. 1 and 2 the fastening element 22 is plane in relation to the plane seating surface 26 on the fastening plate 4, whereby the thickly raised form 28 forms a stop angle along a lateral edge 31 that prevents the fastening element 22 from tilting relative to the fastening plate 4. The fastening element 22 is reliably fixed on the fastening plate 4 using a single fastening screw 32 that is screwed through a bore 33 in the fastening element 22 as well as through a recess 34 in the fastening plate 4 into the side wall 3 of the body of the piece of furniture. Additional fastening means for the fastening element 22 on the fastening plate 4 are not required. The thickly raised form 28 simultaneously specifies an alignment of the damping cylinder 20 that is arranged in the hollow cylindrical recess 35 in the fastening element 22. A radially protruding flange 36 prevents the damping cylinder 20 from sliding through the hollow cylindrical recess 35 and from disengaging from the fastening element 22.

The guide cap 24 is arranged on the end 23 of the piston rod 21 that faces the lever arm 6. The guide cap 24 comprises a guide groove 37 into which the lever arm 6 extends. A recess 38, whose shape is adapted to the course of the guide groove 37, is formed on the lever arm 6. The guide cap 24 engages in the recess 38 of the lever arm 6. The guide groove 37 that extends into the lever arm 6 provides for a reliable lateral guide of the piston rod 21 during an opening and especially during a closing motion. The recess 38, into which the guide cap 24 engages, prevents the guide cap 24 and thus the piston rod 21 from shifting laterally along the lever arm 6 during an opening or closing motion.

The damping device 18 can be manufactured cost-effectively and can be sold and mounted together with a customary, non-dampened furniture hinge. Already completely mounted furniture hinges can be retrofit with the damping device. Mounting only requires minimal effort. An adjustment of the damping device 18 relative to the fastening plate 4 and the lever arm 6 is facilitated or, respectively, specified by the thickly raised forms 27, 28. Due to the symmetrical shape of the fastening element 22 or, respectively, the damping device 18, the damping device 18 can be used independent of the respective furniture hinge that is used or, respectively, independent of its fastening to a left or right end of the hinged lid 14.

The invention claimed is:

1. Furniture hinge for a hinged lid arranged in a horizontally swiveling manner on a body of a piece of furniture comprising:

a fastening plate, a swivel plate arranged in a swiveling manner on the fastening plate by means of two lever arms that are arranged as parallel linkages, and a damping device fixed on the fastening plate, wherein the damping device comprises a damping cylinder and a piston rod that can be displaced in a dampening manner inside the damping cylinder, the piston rod contacting one lever arm of the two lever arms, the damping device comprises a fastening element in which the damping cylinder can be fastened, and the fastening element comprises a plane seating surface and an angled stop angle at an angle to the plane seating surface.

2. Furniture hinge according to claim 1, wherein the piston rod rests on the one lever arm and counteracts the swiveling motion of the one lever arm during a closing motion of the hinged lid.

3. Furniture hinge for a hinged lid arranged in a horizontally swiveling manner on a body of a piece of furniture comprising:

a fastening plate, a swivel plate arranged in a swiveling manner on the fastening plate by means of two lever arms that are arranged as parallel linkages, and a damping device fixed on the fastening plate, wherein the damping device comprises a damping cylinder and a piston rod that can be displaced in a dampening manner inside the damping cylinder, the piston rod contacting a lever arm of the two lever arms, the damping device comprises a fastening element in which the damping cylinder can be fastened, and wherein the fastening element comprises a plane seating surface and an angled stop angle at an angle to the plane seating surface on opposite sides of the fastening element so that the fastening element can be fixed to a piece of furniture on either one of the opposite sides.

4. Furniture hinge according to claim 1, wherein the fastening element comprises a bore for a fastening screw.

5. Furniture hinge for a hinged lid arranged in a horizontally swiveling manner on a body of a piece of furniture comprising:

a fastening plate, a swivel plate arranged in a swiveling manner on the fastening plate by means of two lever arms that are arranged as parallel linkages, and a damping device fixed on the fastening plate, wherein a guide cap with a guide groove whose dimensions are adapted to a thickness of a lever arm of the two lever arms is arranged on an end of the piston rod facing the lever arm.

6. Furniture hinge according to claim 5, wherein the guide groove runs in a plane specified by the swiveling motion of the lever arm and has a curvilinear course.

7. Furniture hinge according to claim 1, wherein the lever arm comprises a recess into which the piston rod or a guide cap at an end of the piston rod engages.

* * * * *